US006600450B1

(12) United States Patent
Efanov et al.

(10) Patent No.: US 6,600,450 B1
(45) Date of Patent: Jul. 29, 2003

(54) BALANCED MULTI-BAND ANTENNA SYSTEM

(75) Inventors: Andrew A. Efanov, Crystal Lake, IL (US); James P. Phillips, Lake in the Hills, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/091,666

(22) Filed: Mar. 5, 2002

(51) Int. Cl.[7] ..... H01Q 21/00

(52) U.S. Cl. ..... 343/726; 343/700 MS; 343/702

(58) Field of Search ..... 343/702, 742, 343/867, 741, 866, 725, 726, 700 MS

(56) References Cited

U.S. PATENT DOCUMENTS

| | | | | | |
|---|---|---|---|---|---|
| 5,014,346 | A | | 5/1991 | Phillips et al. | 455/89 |
| 5,170,173 | A | | 12/1992 | Krenz et al. | 343/702 |
| 5,451,965 | A | * | 9/1995 | Matsumoto | 343/702 |
| 5,542,106 | A | | 7/1996 | Krenz et al. | 455/90 |
| 5,572,223 | A | * | 11/1996 | Phillips et al. | 343/702 |
| 5,809,433 | A | | 9/1998 | Thompson et al. | 455/575 |
| 5,995,052 | A | | 11/1999 | Sadler et al. | 343/702 |
| 6,011,519 | A | | 1/2000 | Sadler et al. | 343/742 |
| 6,198,943 | B1 | * | 3/2001 | Sadler et al. | 343/702 |
| 6,266,538 | B1 | | 7/2001 | Waldron | 455/550 |
| 6,300,910 | B1 | | 10/2001 | Kim | 343/702 |
| 6,307,511 | B1 | | 10/2001 | Ying et al. | 343/702 |
| 6,327,485 | B1 | | 12/2001 | Waldron | 455/575 |

OTHER PUBLICATIONS

The ARRL Antenna Book, The American Radio Relay League, 18th Ed., 1997, pp. 18–5, 26–6, 26–7.

* cited by examiner

*Primary Examiner*—Hoang Nguyen
(74) *Attorney, Agent, or Firm*—Brian M. Mancini

(57) ABSTRACT

A balanced antenna system for a communication device includes a balanced transmission line electromagnetically coupled to a transceiver of the device. A symmetrical dipole antenna element is operable at a first frequency driven by the balanced transmission line. A symmetrical loop antenna shares portions of the dipole antenna element and is operable at a second frequency driven by the transmission line. Preferably, the antenna system is disposed within a flip portion of the device housing.

18 Claims, 3 Drawing Sheets

BALANCED MULTI-BAND ANTENNA SYSTEM

FIELD OF THE INVENTION

The present invention relates generally to radio antennas, and more particularly to an antenna for portable communication devices.

BACKGROUND OF THE INVENTION

Modern styling trends dictate contradictory requirements in the design of hand-held communication devices such as cellular phones. On the one hand, consumers are very interested in smaller phones with concealed (internal) antennas that are not susceptible to damage by catching on clothing or other objects. On the other hand, it is necessary to achieve adequate antenna electrical performance. In addition, wireless handheld communication devices, such as cellular telephones, transmit RF power and are carefully scrutinized for their level of RF radiation emissions.

Typically, internal antennas are placed on top-rear side of a cellular phone. However, there are two technical problems related to this solution, as phones become increasingly smaller: a) a user's hand, which holds the phone, almost entirely blocks the antenna. This can deteriorate antenna performance well below acceptable level, and b) internal antennas can excite RF currents on a chassis of the phone, which is placed close to the user. This can require reducing output RF power in order to meet RF exposure standards. Hence, placement of a concealed antenna on top-rear side of a small phone is not recommended.

The highest level of RF exposure is most often from RF currents flowing on or in the conductive parts of the housing of the device and not on the antenna. Prior art methods of reducing or eliminating the RF currents of the housing have resulted in the use of large and unwieldy antennas or large RF currents that cause large reactive near fields of the antenna such that it then becomes the dominant source of RF exposure. In either case, the size of the antenna and phone increases, which is undesirable.

The size of portable communication devices has historically been set by the size of the enclosed electronics and the battery. Consumer and user demand has continued to push a dramatic reduction in the size of communication devices. As a result, during transmission, the antenna induces higher RF current densities onto the small housing, chassis or printed circuit boards of the communication device in an uncontrolled manner. These RF currents are often dissipated rather than efficiently contributing to the radiation of RF communication signals. The dissipation of RF power can detrimentally affect the circuitry on very small units. Moreover, this loss of power lowers the quality of communication and reduces battery life of the device. These problems are compounded when a device and antenna system is required to operate over multiple frequency bands.

Accordingly, what is needed is a communication device having a multi-band antenna configuration that is less likely to experience signal degradation due to use by consumer. In particular, it would be of benefit to provide an antenna that is directed away from the proximity of the user. It would also be beneficial to exclude a phone's chassis from being a counterpoise for antenna and, hence, reduce RF currents on the phone's chassis. Additionally, it would be an advantage to accomplish these needs without: reduced antenna efficiency at the talking position, decreased battery life, or increased size or cost of the communication device.

DETAILED DESCRIPTION OF THE PREFERRED EMBODIMENTS

Figure 1:
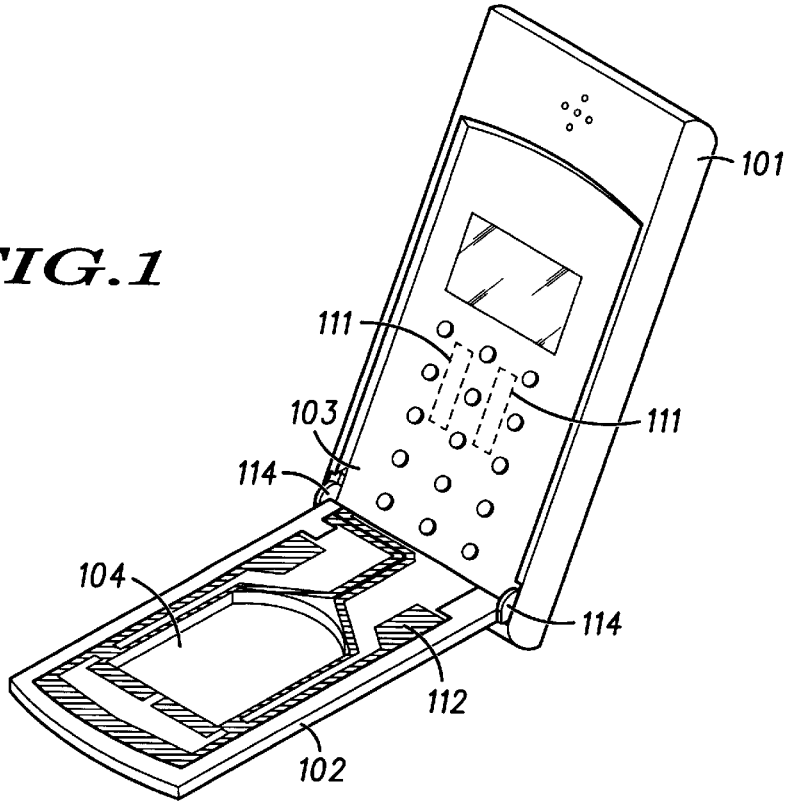
FIG. 1 is a perspective view of a radiotelephone in an opened position with a flip having an antenna system, in accordance with the present invention.

The present invention provides a communication device having a balanced dual-band antenna configured in a movable thin flip portion attached to the bottom of the device. Advantageously, this configuration provides a solution for antenna efficiency in small devices since it is less likely that a user's hand would block the antenna and there is substantial spacing between the antenna and the user at the talking position. As a result, the device is less likely to experience signal degradation due to use by consumer since the antenna is directed away from the proximity of the user. In addition, the balanced antenna configuration provides the benefit of excluding a phone's chassis from being a counterpoise for antenna and, hence, to reduce RF currents on the phone's chassis. The RF currents of the device are located in a smaller, more favorably located area on the phone. This results in a reduction in the near field strength on the face of the phone without inhibiting transmit efficiency. In addition, the balanced antenna configuration retains the RF current in the antenna system and away from those portions of the chassis or housing that are proximate to the user, thereby increasing battery life, without increased size or cost of the communication device.

As portable communication technology has advanced, antenna efficiency and electromagnetic exposure have become issues in two-way (transmit) hand-held wireless communication products. Smaller, hand-held, wireless communication products are demanded by the market and meeting antenna efficiency and electromagnetic exposure requirements are more difficult. The present invention provides a balanced antenna system to control antenna radiation in while also removing the antenna from close proximity of the user without inhibiting efficiency. This invention combines dipole and loop antenna elements within a novel single antenna configuration to allow operation at more than one frequency. In addition, the present invention takes into account the common practice of placing other devices on a flip portion of a phone, which might otherwise constrain operation of the antenna system. For example, a flip might contain a window to see a display of the device when the flip is closed, or several buttons and its own display to enabling some input from a user at the flip-closed position. These devices might ordinarily degrade antenna performance due to their location on the flip portion.

The invention will have application apart from the preferred embodiments described herein, and the description is provided merely to illustrate and describe the invention and it should in no way be taken as limiting of the invention. While the specification concludes with claims defining the features of the invention that are regarded as novel, it is believed that the invention will be better understood from a consideration of the following description in conjunction with the drawing figures, in which like reference numerals are carried forward. As defined in the invention, a radiotelephone is a communication device that communicates information to a base station using electromagnetic waves in the radio frequency range. In general, the radiotelephone is portable and, when used, is typically held up to a person's head, next to their ear.

The concept of the present invention can be advantageously used on any electronic product requiring the transceiving of RF signals. Preferably, the radiotelephone portion of the communication device is a cellular radiotelephone adapted for personal communication, but may also be a pager, cordless radiotelephone, or a personal communication service (PCS) radiotelephone. The radiotelephone portion may be constructed in accordance with an analog communication standard or a digital communication standard. The radiotelephone portion generally includes a radio frequency (RF) transmitter, a RF receiver, a controller, an antenna, a battery, a duplex filter, a frequency synthesizer, a signal processor, and a user interface including at least one of a keypad, display, control switches, and a microphone. The radiotelephone portion can also include a paging receiver. The electronics incorporated into a cellular phone, two-way radio or selective radio receiver, such as a pager, are well known in the art, and can be incorporated into the communication device of the present invention.

FIG. 1 illustrates a communication device according to the present invention. By way of example only, the communication device is embodied in a cellular radiotelephone having a conventional cellular radio transceiver circuitry, as is known in the art, and will not be presented here for simplicity. The cellular telephone, includes conventional cellular phone hardware (also not represented for simplicity) such as user interfaces that are integrated in a compact housing, and further includes an antenna system, in accordance with the present invention. Each particular wireless device will offer opportunities for implementing this concept and the means selected for each application.

Figure 2:
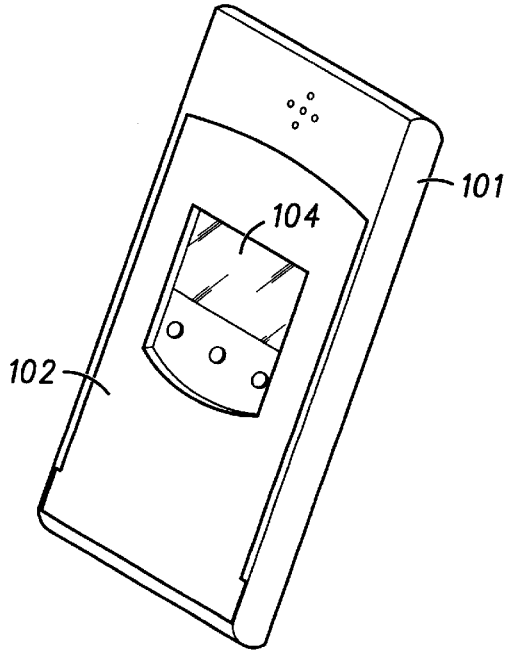
FIG. 2 is a perspective view of FIG. 1 in a closed position.

As shown in FIG. 1, an antenna system is integrated into a communication device such as a portable radiotelephone 101. The radiotelephone has a movable flip potion 102. The flip portion 102 is attached to the radiotelephone 101 by a rotational hinge mechanism 114, which provides a plurality of operational positions for the flip portion 102. The position shown is with the flip opened, extending outwardly from the housing in an extended position. Another position is with the flip closed (FIG. 2). Other intermediate operational flip positions can be used, also. The present invention provides an antenna system 112 integrated into the flip portion 102. The flip portion 102 can also contain large exposed areas 104, which are dedicated for a window, display, or some keys or other user interface. The areas are defined by an aperture through opposing sides surfaces of the flip portion. These areas 104 of the flip portion 102 are not available for antenna integration as they extend through the flip portion.

Figure 3:
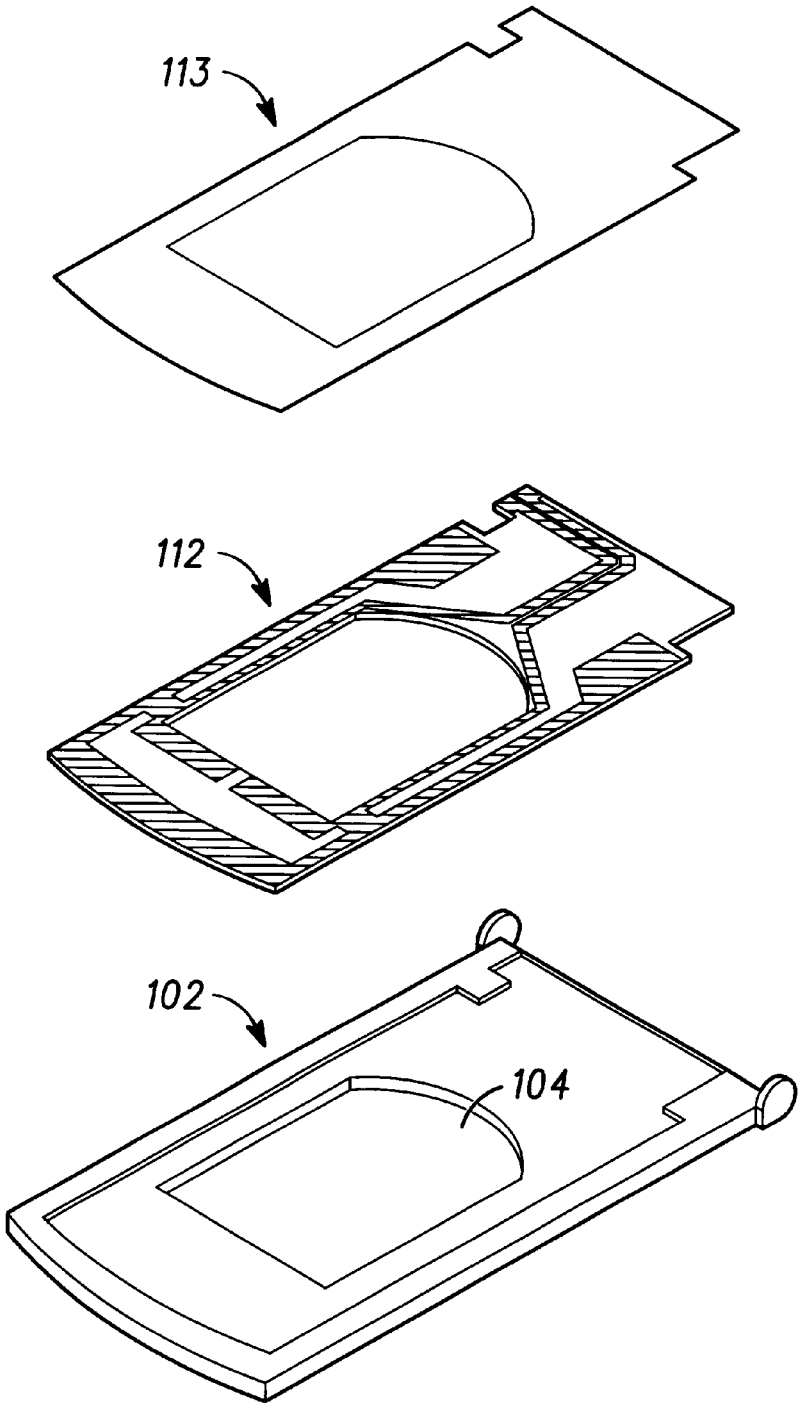
FIG. 3 is an exploded view of the flip portion with incorporated antenna of FIG. 1.

Referring to FIG. 3, the antenna 112 is positioned between the flip portion 102 and a flip cover 113. Both the flip portion 102 and the flip cover 113 are made of a suitable dielectric material, such as an organic polymer. The flip portion 102 has a recess to accept the antenna 112. The antenna 112 is sandwiched between the flip portion 102 and the flip cover 113. All three parts (antenna 112, flip portion 102 and flip cover 113) are attached together. This can be accomplished using an adhesive or other type of fastening device. The antenna 112 is manufactured of thin conductive strips of a suitable conductor, such as copper, or the like, embedded in a thin dielectric substrate.

Figure 4:
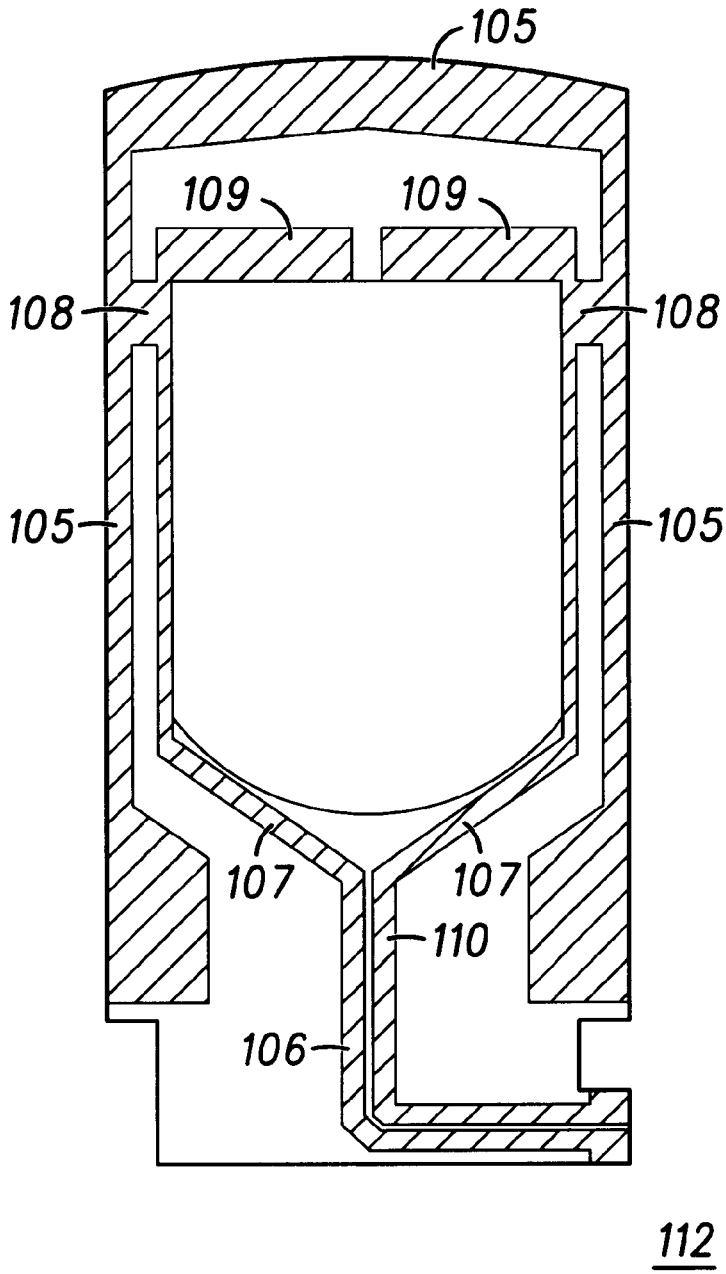
FIG. 4 is a plan view of an antenna configuration layout, in accordance with the present invention.

Referring to FIG. 4, in a preferred embodiment, the antenna 112 is configured for dual-band operation. However, in general, the antenna configuration is not limited to just two operating bands. The antenna configuration includes a symmetric bent dipole 105 coupled with a pair of symmetric delta-match conductors 107, which are operable at a first frequency. In addition, the symmetric delta-match conductors 107 and the top portion of the bent dipole 105 form a loop antenna operable at a second frequency. The antenna 112 is fed at the feeding point 110 by a balanced transmission line 106. The antenna configuration is fully symmetric relatively to a longitudinal center axis of the flip 102. The symmetry of antenna configuration, simultaneously with the use of the balanced feeding transmission line 106, both provide a balanced mode of antenna operation.

The bent dipole 105 is disposed around the outside edge of the flip portion 102. The dipole 105 is symmetric relatively to a longitudinal center axis of the flip 102. The overall length of the bent dipole 105 is chosen in such a way, that it provides a first resonance at a lower operating band. Preferably, the dipole is tuned at 900 MHz, and its overall length is close to a half-wavelength at its operating frequency.

A pair of symmetric delta-match conductors 107 is placed around the edge of the dedicated areas 104 of the flip potion 102. The conductors 107 provide an impedance transformation between the dipole 105 and transmission line 106. The delta-match conductors 107 are connected to the dipole 105 at the contact points 108. The actual position of the contact points 108 is selected in such a way, that a good impedance match is provided between the dipole 105 and transmission line 106 at the lower operating band.

The delta-match conductors 107 and the top portion of the bent dipole 105 between the contact points 108 form a second, loop antenna operable at a second higher frequency band. The first and second antennas share the delta-match conductors 107 forming a balanced dual-band loop-dipole hybrid antenna system. Although the dipole and loop are physically coupled to a common transmission line 106, with the loop antenna effectively driven by the same, the dipole is effectively driven at the contact points due to the delta-match conductors. Optionally, a second pair of conductive arms 109 is connected to the delta-match conductors 107 close to the contact points 108 and driven thereby. Preferably, these second pair of conductive arms 109 can be resonant at or near the second frequency band and used for tuning that band. In this case, the lengths of both conductive arms 109 to are chosen in such a way to tune the frequency of this higher frequency band. The effective length can be changed through electromagnetic coupling to other components. In addition, the physical length can be changed for optimum tuning through material addition or subtraction techniques known in the art. Alternatively, the second pair of conductive arms 109 can be chosen to provide a resonance at a third frequency, different from the first and second frequencies, to support multi-band operation. Additional pairs of conductive arms can be attached to antenna system in a similar way to support multi-band operation, i.e. at a third or more frequencies, different from the first and second frequencies.

The balanced transmission line 106 connects the antenna system feeding point 110 to transceiver circuits (not shown) of the communication device 101. This can be provided by a flexible hardwired connection (not shown) through the hinge mechanism, 114 of FIG. 1, of the flip portion 102. Alternatively, the connection to the transceiver is accomplished through capacitive or inductive coupling through the hinge mechanism. Preferably, the connection is via an inductive coupler 103 incorporated into a rotational hinge mechanism 114, similar to the one described in U.S. Pat. No. 5,014,346, hereby incorporated by reference. The inductive coupler 103 operates as a balanced-to-unbalanced mode transformer, providing good suppression of undesired unbalanced-mode RF currents over the transmission line 106. Although one coupling 103 is shown, more than one of the hinge points can be used to support different transmission line couplings (not shown). Antenna configuration symmetry and a balanced feed provide a balanced mode of antenna operation. This effectively excludes phone's chassis from being a part of antenna radiating system, and suppresses undesirable RF currents on the phone's chassis, thereby reducing near field emissions and increasing antenna radiation efficiency.

Operation of the antenna 112 in the flip-closed position is provided by means that are similar to that described in U.S. Pat. No. 5,542,106, hereby incorporated by reference. When the flip portion 102 is in the closed position, its input impedance is changed, because of the close proximity of the phone 101. Preferably, the front part of the the radiotelephone housing is made of a non-conductive material, such as an organic polymer. More preferably, the front part of the the radiotelephone housing contains at least one conductive plate (111 as shown in FIG. 1), which is embedded in the front part of the housing. When the flip portion 102 is in the second (closed) position (represent in FIG. 2), conductive plates 111 are in close proximity to the antenna system, and particularly the delta-match conductors. The conductive plates electrically coupled to the antenna conductors in such a way, that antenna input impedance is corrected to compensate for impedance changes due to bringing the antenna close to other conductive portions of the device. In other words, the conductive plates insure matching with the balanced transmission line 106. When the flip portion is in the open position the conductive plates have a minimal effect on the impedance of the antenna.

In summary, it should be recognized that the present invention is a radiotelephone antenna-housing improvement and technique that optimizes a radiotelephone's transceiver efficiency. It can also reduce current draw and extend battery life due to this improved efficiency. As such, its benefits apply to any sort of antenna element or exciter. Although a dipole/loop example is given, the invention is equally applicable to other antenna structures as are known in the art.

It is to be understood that the phraseology or terminology employed herein is for the purpose of description and not of limitation. Accordingly, the invention is intended to embrace all such alternatives, modifications, equivalents and variations as fall within the broad scope of the appended claims.

What is claimed is:

1. A balanced antenna system for a communication device having a transceiver disposed within a housing, the system comprising:

a balanced transmission line electromagnetically coupled to the transceiver;

a symmetrical bent dipole antenna element coupled to the balanced transmission line, the bent dipole antenna operable at a first frequency; and a symmetrical loop antenna connected to the balanced transmission line, the loop antenna sharing portions of the bent dipole antenna element, the loop antenna operable at a second frequency.

2. The system of claim 1, wherein the bent dipole is coupled at contact points with symmetric delta-matched conductors connected to the transmission line, and the loop antenna is formed from the delta-matched conductors and the portion of the bent dipole element between the contact points.

3. The system of claim 2, further comprising a pair of conductive arms connected to the delta-match conductors near the contact points.

4. The system of claim 3, wherein the pair of conductive arms provide tuning for the loop antenna.

5. The system of claim 3, wherein the pair of conductive arms provide a resonance near the second operating frequency.

6. The system of claim 3, wherein the pair of conductive arms provide a resonance at a third operating frequency.

7. The system of claim 3, further comprising a second pair of conductive arms connected to the delta-match conductors near the contact points, the second pairs of conductive arms provide a resonance at a third operating frequency.

8. The system of claim 1, further comprising a movable flip portion connected through a hinge assembly to the housing, wherein the antenna system is disposed in the flip portion of the communication device.

9. The system of claim 8, wherein the transmission line is inductively coupled to the transceiver through the hinge assembly.

10. The system of claim 8, wherein the flip-portion has an open and a closed position, and wherein the housing contains at least one conductive plate disposed therein such that when the flip portion is in a closed position against the housing the conductive plates tune an antenna impedance for correct matching to the transmission line.

11. The system of claim 8, wherein the flip portion includes a window area exposed therethrough, and wherein the loop antenna is disposed in a symmetrical arrangement around the window.

12. A balanced hybrid loop-dipole antenna system for a communication device having a transceiver disposed within a housing and a flip portion coupled to the housing through a hinge assembly, the system comprising:

a balanced transmission line electromagnetically coupled to the transceiver;

a symmetrical dipole antenna element coupled at contact points with symmetric delta-matched conductors connected to the balanced transmission line, the dipole antenna operable at a first frequency; and a symmetrical loop antenna connected to the balanced transmission line, the loop antenna formed from the delta-matched conductors and the portion of the dipole element between the contact points, the loop antenna operable at a second frequency.

13. The system of claim 12, further comprising a pair of conductive arms connected to the delta-match conductors near the contact points, the pair of conductive arms provide a resonance frequency at one of the second operating frequency or a third operating frequency.

14. The system of claim 12, wherein the antenna system is disposed in the flip portion of the communication device.

15. The system of claim 12, wherein the flip portion has an open and a closed position, and wherein the housing contains at least one conductive plate disposed therein such that when the flip portion is in a closed position against the housing the conductive plates tune an antenna impedance for correct matching to the transmission line.

16. The system of claim 12, wherein the flip portion includes a window area exposed therethrough, and wherein the loop antenna is disposed in a symmetrical arrangement around the window.

17. A balanced hybrid loop-dipole antenna system for a communication device having a transceiver disposed within a housing and a flip portion coupled to the housing through a hinge assembly, the system comprising:

a balanced transmission line electromagnetically coupled to the transceiver;

a symmetrical dipole antenna element coupled at contact points with symmetric delta-matched conductors connected to the balanced transmission line, the dipole antenna disposed in the flip portion of the communication device and being operable at a first frequency; and a symmetrical loop antenna connected to the balanced transmission line, the loop antenna disposed in the flip portion of the communication device and formed from the delta-matched conductors and the portion of the dipole element between the contact points, the loop antenna being operable at a second frequency.

18. The system of claim 17, wherein the flip portion includes a window area exposed therethrough, and wherein the loop antenna is disposed in a symmetrical arrangement around the window.

* * * * *